US005921408A

United States Patent [19]

Groenewold et al.

[11] Patent Number: 5,921,408

[45] Date of Patent: Jul. 13, 1999

[54] CUTLERY DISPENSER

[75] Inventors: Keith Groenewold, Shelton; Patrick Zimmer, Cos Cob, both of Conn.

[73] Assignee: Fort James Corporation, Richmond, Va.

[21] Appl. No.: 08/964,030

[22] Filed: Nov. 4, 1997

[51] Int. Cl.[6] ..... A47F 5/00

[52] U.S. Cl. ..... 211/70.7; 312/42; 211/49.1; D7/637; 229/122; 206/553; 206/497

[58] Field of Search ..... 211/59.2, 49.1, 211/70.7; 312/42; 206/553, 497; 248/37.3; 229/122; D7/637

[56] References Cited

U.S. PATENT DOCUMENTS

| | | | |
|---|---|---|---|
| 2,037,576 | 4/1936 | Handel | 312/42 |
| 2,325,604 | 8/1943 | Gibbs et al. | 312/42 |
| 2,340,561 | 2/1944 | Renflo | 312/42 |
| 2,421,782 | 6/1947 | Gibbs et al. . | |
| 2,871,079 | 1/1959 | Barrett . | |
| 3,115,968 | 12/1963 | Peterson | 211/49.1 X |
| 3,132,765 | 5/1964 | Florendo . | |
| 3,740,238 | 6/1973 | Graham | 211/49.1 X |
| 3,744,866 | 7/1973 | Cook | 312/42 |
| 4,365,709 | 12/1982 | Lester . | |
| 4,767,022 | 8/1988 | Oldorf . | |
| 4,801,045 | 1/1989 | Barnhart | 229/122 X |
| 5,190,168 | 3/1993 | French et al. . | |
| 5,332,106 | 7/1994 | Schlotte et al. | 211/70.7 |

OTHER PUBLICATIONS

The Country Gourmet, Lucite Buffet Stackers, p. 191, Oct. 1974, House and Garden.

The Country Gourmet, Buffet Stackers, p. 105, Jan. 1974, House Beautiful.

*Primary Examiner*—Robert W. Gibson, Jr.

*Attorney, Agent, or Firm*—Sixbey, Friedman, Leedom & Ferguson; Charles M. Leedom, Jr.; Donald R. Studebaker

[57] ABSTRACT

A flatware dispensing unit for dispensing flatware is disclosed including a primary housing having at least one compartment for receiving flatware therein with the compartment having an elongated slot for exposing at least a portion of the flatware. In a first embodiment, a cartridge having a complimentary elongated slot substantially aligned with the elongated slot in the compartment when the cartridge is positioned within the compartment. The flatware cartridge includes a widened portion which when inserted into the compartment aligns with a widened portion of the elongated slot of the compartment. In doing so, the cartridge may be easily dropped into the compartment such that the flatware need not be individually handled by the person stocking the dispenser unit and limits the number of utensils which can be removed from the dispenser at one time. In accordance with a preferred embodiment of the present invention, the flatware dispensing unit for dispensing flatware includes at least one flatware cartridge containing a plurality of flatware pieces temporarily receivable in the compartment. The cartridge itself includes a plurality of flatware oriented in the same manner forming a bulk oriented stack of flatware and a flexible enclosure enclosing the bulk oriented stack of flatware and maintaining an orientation of the bulk oriented stack of flatware with the bulk oriented stack of flatware in the flexible enclosure being positioned in the flatware dispenser, with the flexible enclosure being removable from the bulk oriented stack of flatware. A tearaway portion is preferably included to aid in removal of the flexible enclosure.

47 Claims, 10 Drawing Sheets

CUTLERY DISPENSER

The present invention is directed to a flatware dispensing unit and more particularly to a disposable flatware dispensing unit wherein the unit can be readily restocked with the flatware being easily accessible by the consumer.

BACKGROUND OF THE INVENTION

A significant expense incurred in connection with the operation of a fast food type restaurant or any other relatively informal type restaurant is the costs associated with disposable flatware and tableware. While it is necessary to make the flatware readily accessible to the consumer, there is a need to dispense the flatware in a sanitary manner and one which discourages the consumer from taking more than the necessary number of utensils.

Presently, most restaurants merely place the flatware in bins which are readily accessible to the consumer. The bins are generally open top containers which allows the consumer to remove any number of utensils simultaneously. Clearly, this encourages the consumer to take more utensils than needed which adds to the overall operating costs of the establishment. Also, because all of the flatware is exposed to the consumer, the consumer can readily come in contact with flatware which that particular consumer does not intend to use and consequently the flatware left in the bin may become contaminated. Moreover, because the bins are merely open topped containers, dust and other type contaminants can readily contact the flatware.

A dispensing unit which attempts to overcome a number of these shortcomings is set forth in U.S. Pat. No. 2,421,782 issued to Gibbs et al. Therein a dispenser for flatware is disclosed wherein the flatware is loaded into a dispenser which is subsequently mounted within a casing such that the flatware can be removed by a consumer in a sequential fashion. This case however only accommodates spoons and forks, knives are individually inserted into openings in the casing. Further, the dispensers are filled with reusable flatware by placing individual spoons or forks into the dispenser with a latch member being positioned over the last utensil. This dispenser is then inserted into and retained within the casing. Accordingly, this dispenser unit is intended for dispensing reusable flatware and not prepackaged disposable flatware. Further, this dispenser does not limit the consumer's access to knives which are readily removable from the dispenser.

Therefore, there is clearly a need for a flatware dispensing unit for dispensing flatware wherein the flatware in the form of a prepackaged unit can be positioned within the dispensing unit without contact with the person loading the dispenser unit, one which protects the flatware from contamination once in the dispensing unit and one which while permitting the consumer access to the flatware inhibits the consumer from removing a significant number of flatware pieces at one time.

SUMMARY OF THE INVENTION

It is a primary object of the present invention to overcome the aforementioned shortcomings associated with prior known flatware dispensing systems.

Another object of the present invention is to provide a flatware dispensing unit which may be readily stocked without significant contact being made between the stocking personnel and the flatware itself.

Yet another object of the present invention is to provide a flatware dispensing unit wherein the flatware is protected from the surrounding environment.

Yet another object of the present invention is to provide a flatware dispensing unit for readily dispensing disposable flatware by providing the consumer easy access to the flatware.

An additional object of the present invention is to provide a flatware dispensing unit for dispensing flatware wherein the flatware is readily accessible to the consumer, however, the consumer is inhibited from simultaneously removing a significant number of utensils.

A further object of the present invention is to provide a unitary package which provides for storage of the flatware in a stable manner prior to their positioning in the dispensing unit.

A still further object of the present invention is to provide the flatware in a unitary package for ease in restocking the dispensing unit.

Yet another object of the present invention is to provide a sanitary unitary package for storing, shipping and handling the flatware.

A further object of the present invention is to provide a moisture impervious unitary package for storing, shipping and handling the flatware.

Yet another object of the present invention is to provide a flexible unitary package for storing and shipping the flatware which reduces the bulk storing and shipping volume of the package.

These as well as additional objects of the present invention are achieved in accordance with an initial embodiment of the present invention by providing a flatware dispensing unit for dispensing flatware including a primary housing having at least one compartment for receiving flatware therein with the compartment having an elongated slot for exposing at least a portion of the flatware, at least one flatware cartridge receivable in the compartment with the cartridge having a complimentary elongated slot substantially aligned with the elongated slot in the compartment when the cartridge is positioned within the compartment and a secondary housing position within said primary housing for accommodating and dispensing elongated flatware, with the secondary housing including an opening such that at least a portion of the elongated flatware is accessible through the opening. The flatware cartridge further includes a widened portion which when inserted into the compartment aligns with a widened portion of the elongated slot of the compartment. In doing so, the cartridge may be easily dropped into the compartment such that the flatware need not be individually handled by the person stocking the dispenser unit.

More preferably, the flatware dispensing unit for dispensing flatware in accordance with a preferred embodiment of the present invention includes a housing having at least one compartment for receiving the flatware, the compartment having an elongated slot for exposing at least a portion of the flatware and at least one flatware cartridge containing a plurality of flatware pieces temporarily receivable in the compartment. The cartridge being removable from the compartment while the flatware is retained in the compartment such that the flatware can be sequentially removed from the compartment. More particularly, the cartridge for positioning the plurality of disposable flatware in the flatware dispenser includes a plurality of flatware oriented in the same manner forming a bulk oriented stack of flatware and a flexible enclosure enclosing the bulk oriented stack of flatware and maintaining an orientation of the bulk oriented stack of flatware with the bulk oriented stack of flatware in the flexible enclosure being positioned in the flatware dispenser, with the flexible enclosure being removable from the bulk oriented stack of flatware. Preferably, the flexible enclosure is a heat shrinkable polymer film and includes a line of weakness formed in the polymer film for permitting the ready removal of the polymer film from the bulk oriented stack of flatware. Further, the flexible enclosure may include a tear-away portion defined by the line of weakness such that the tear-away portion can be readily removed before the bulk oriented stack is positioned in the dispenser. By removing the tear-away portion, the remaining portion of the flexible closure can be readily removed from the bulk oriented stack of flatware.

With the preferred embodiment, a method of stocking the flatware dispenser is set forth including the steps of providing a flatware dispensing unit for dispensing flatware, the dispensing unit including a housing having at least one compartment for receiving the flatware and having an elongated slot for exposing at least a portion of said flatware, providing a plurality of flatware oriented in the same manner forming a bulk oriented stack of flatware, the bulk oriented stack of flatware being enclosed in a flexible enclosure for maintaining an orientation of the bulk oriented stack of flatware, positioning the enclosed bulk oriented stack of flatware in the compartment having a portion of the flatware enclosed in the flexible enclosure extending from the compartment and removing the flexible enclosure from the compartment leaving the bulk oriented stack of flatware retained in the compartment such that the flatware can be sequentially removed from the compartment.

These as well as additional advantages of the present invention will become apparent from the following detailed description of the preferred embodiment when read in light of the several figures.

DETAILED DESCRIPTION OF THE PREFERRED EMBODIMENT

Figure 1:
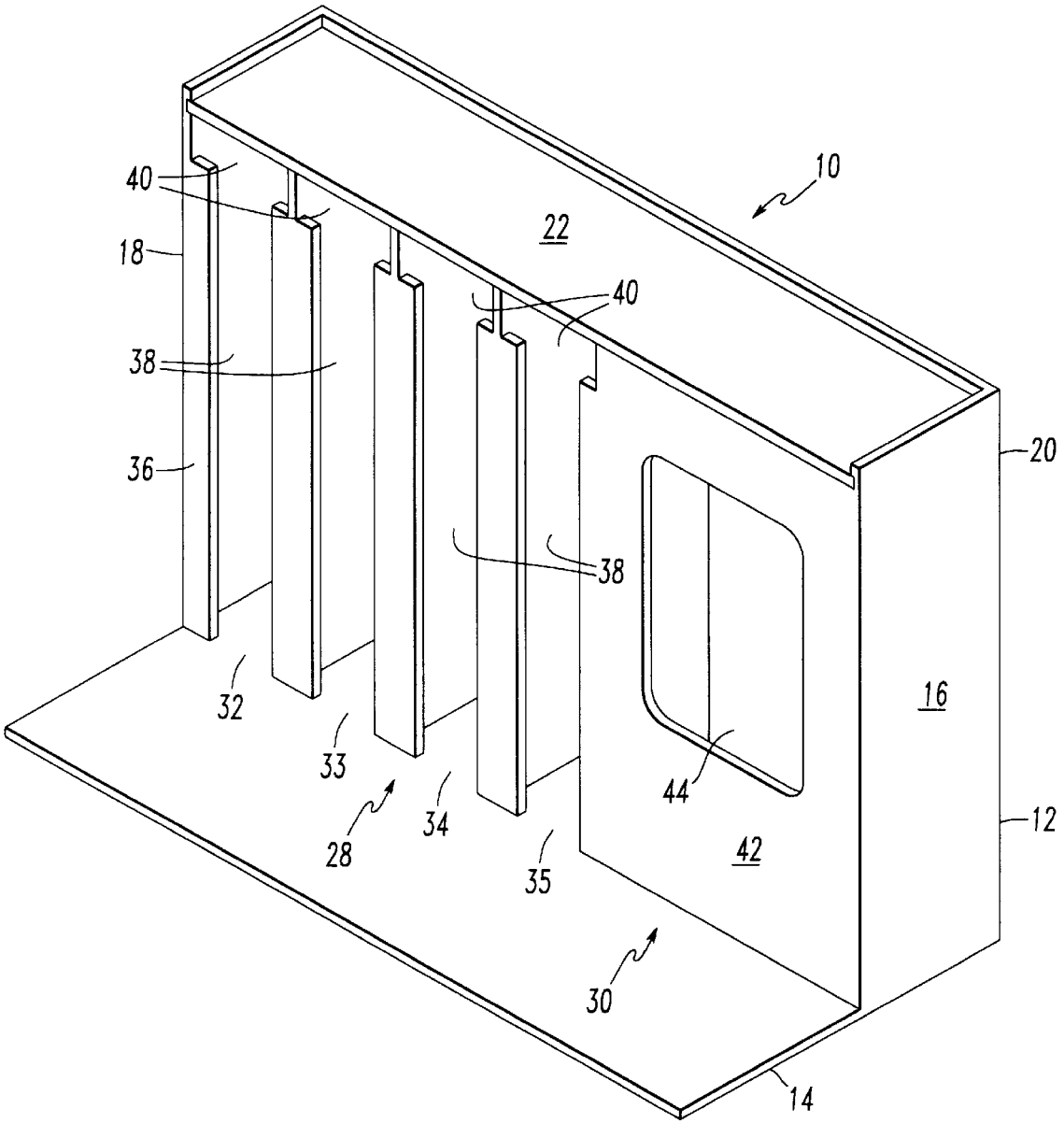
FIG. 1 is a perspective view of a flatware dispensing unit for dispensing flatware in accordance with an initial embodiment of the present invention.

Referring now to the several figures and particularly FIGS. 1 and 2 thereof, the flatware dispensing unit for dispensing flatware in accordance with an initial embodiment of the present invention will now be described in detail hereinbelow. FIG. 1 illustrates a dispensing unit 10 which includes a main housing 12 having a substantially planar base 14 and sidewalls 16, 18 and 20. The particular configuration of the sidewalls 16 and 18 are set forth for illustrative purposes and are formed in accordance with an illustrative embodiment of the present invention. However, the sidewalls 16 and 18 may take on any configuration so long as the functional aspects thereof are maintained.

The housing 12 includes a top 22 which is slidably received in slots 24 formed in sidewalls 16, 18 and 20 such that the top 22 may be readily removed from the housing 12, the significance of which will be described in greater detail hereinbelow. The housing 12 is divided into two sections, one being a compartmented portion 28 and the other being a secondary housing portion 30. The compartmented section is divided into essentially four compartments with two being provided for spoons and the others being provided for forks. While four compartments are illustrated in connection with the illustrated embodiment, any number of compartments can be provided depending upon the number of utensils the unit is to hold. Further, while one compartment section and one secondary housing section is illustrated, any number or combination of such sections may be provided. Additionally, the several compartments may receive either spoons, forks or knives such that any combination of utensils may be dispensed.

Referring particularly to the compartmented section 28, this section includes compartments 32–35 which are positioned adjacent one another and may be separated by partitions positioned therebetween. Each of the compartments 32–35 include a singular front wall 36 with the front wall having an elongated slot 38 provided for each of the compartments 32–35. The significance of the elongated slots will become apparent from the following discussion. In addition to the elongated slots, a widened portion or transverse slot 40 is provided at a top portion of each of the compartments 32–35 which permits the bowl portion of a spoon, the tines of a fork or the blade of a knife to pass therethrough. The removable top 22 of the compartmented section 28 allows for a cartridge of spoons, forks or knives to be easily dropped into the respective compartment which allows the dispenser to be rapidly filled. Once the cartridge is in place, the lid can then be returned to the position illustrated in FIG. 1.

While knives may be dispensed from the compartments 32–35, the secondary housing 30 may be provided for accommodating elongated utensils such as knives or straws. The front wall 42 of the secondary housing 30 includes an opening 44. The secondary housing 30 is designed to receive a cartridge of knives in a manner similar to that of the compartments 32–35 by the removal of the top wall 22. With the top wall 22 removed, a cartridge which maintains the knives in an upright position is dropped into the secondary housing such that a handle of knives is accessible through opening 44. This feature will be discussed in greater detail hereinbelow.

Figure 2:
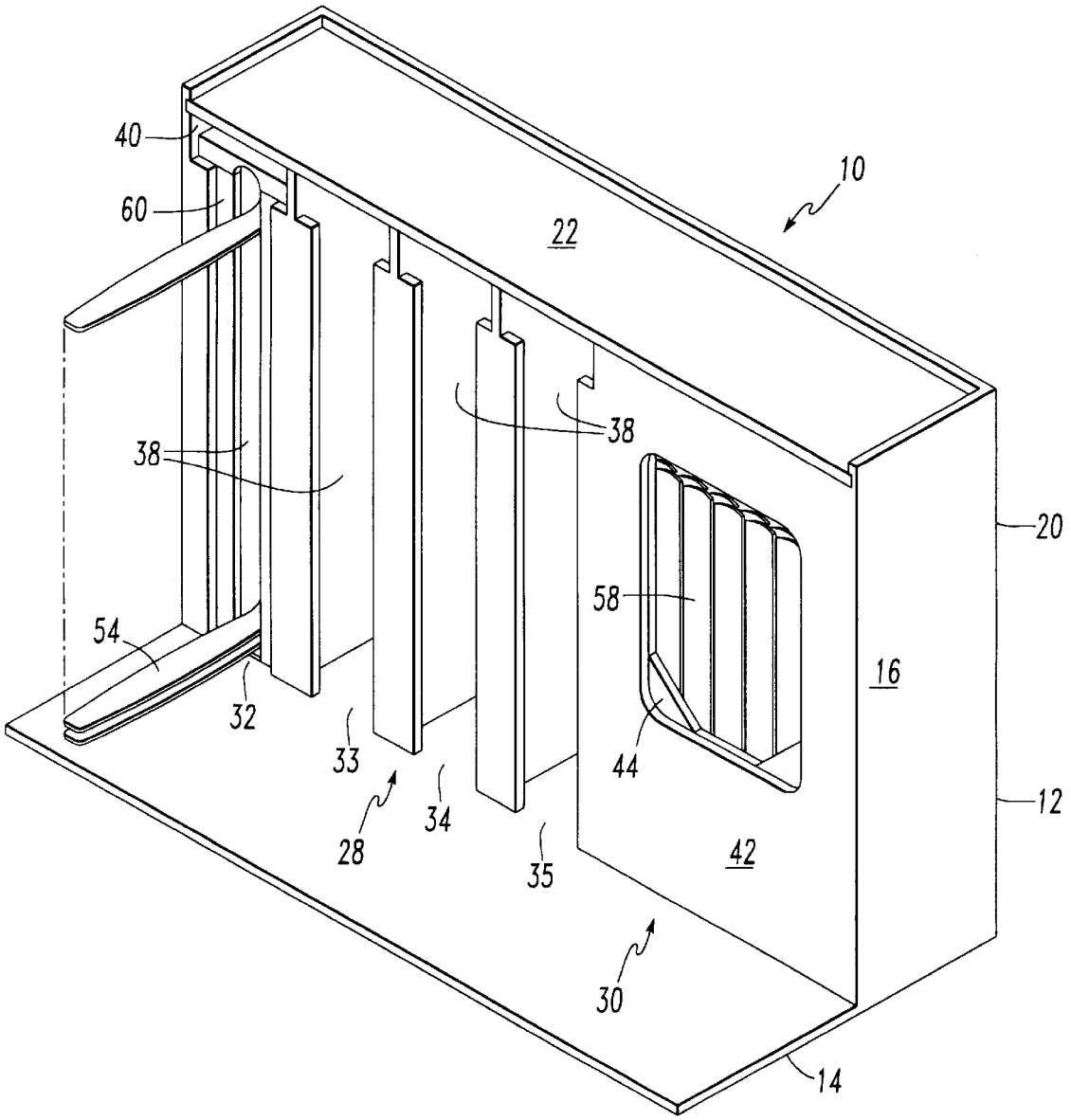
FIG. 2 is a perspective view of the flatware dispensing unit for dispensing flatware in accordance with the initial embodiment of the present invention in its partially loaded condition.

Referring now to FIG. 2, the flatware dispensing unit is illustrated in its partially filled state wherein spoons 54 are positioned in the compartment 32 and knives 58 are provided within the secondary housing 30. As can be seen from FIG. 2, the flatware is readily accessible by the consumer however the consumer is limited in the number of utensils which can be simultaneously removed from the dispensing unit. That is, to remove either a spoon or a fork, the utensil must be lifted to a position adjacent the widened section 40 of the elongated slots 38 such that the bowl portion of the spoon or the tine portion of the fork can be removed by pulling the spoon or fork outwardly. The remaining utensils cannot be removed from the unit until an uppermost utensil is removed and then only one utensil can be removed at a time.

Figure 3:
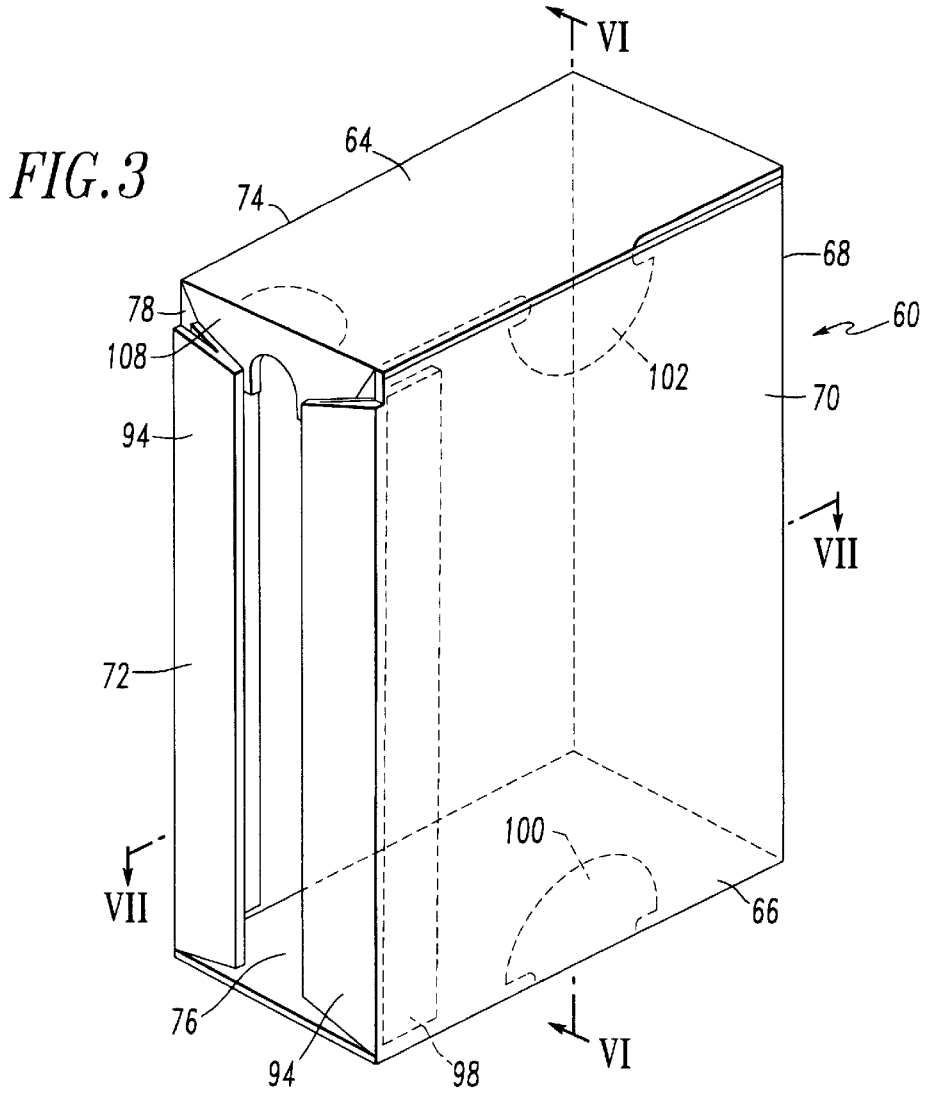
FIG. 3 is a perspective view of a cartridge for containing flatware to be dispensed from the dispensing unit illustrated in FIGS. 1 and 2.
Figure 7:
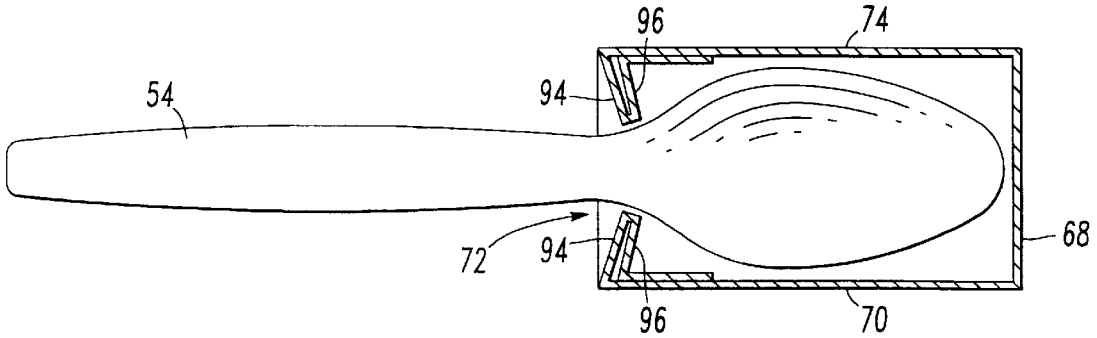
FIG. 7 is a cross-sectional top view of the cartridge illustrated in FIG. 3 taken along line VII—VII and having flatware therein.

As can be seen from FIG. 2, in accordance with an initial embodiment of the present invention, the flatware 54 are positioned within their respective compartments and are contained within a cartridge 60. Such a cartridge is illustrated in detail in FIG. 3 and is formed from the paperboard blank illustrated in FIGS. 4 and 5. With reference to FIG. 3, the cartridge 60 is formed of a paperboard material and is of a rectangular configuration such that it can be readily received within any one of the compartments 32–35. The particular configuration of the cartridge 60 is dictated by the particular configuration of the compartments 32–35 such that the cartridge can be readily received therein. The cartridge includes top and bottom walls 64 and 66 as well as sidewalls 68, 70, 72 and 74. Formed in the sidewall 72 is a complementary elongated slot 76 which extends substantially the entire length of the sidewall 72. Adjacent an upper end of the elongated slot 76 is a widened section 78 which when the cartridge 60 is positioned within one of the compartments 32–35, aligns with the widened portion 40 formed in the compartment. Likewise, the complementary elongated slot 76 aligns with the elongated slots 38 formed in the compartment. As is illustrated in FIG. 7, the handle portion of the flatware contained within the cartridge 60 extends through the elongated slot 76 formed in the sidewall 72. With reference to FIG. 2, it can be seen that the bowl portion of the spoon or the tine portion of the fork is retained within the cartridge 60 and can only be removed in the manner illustrated in FIG. 6. When removing the utensil 54 from the cartridge 60 and ultimately from the compartment 32, the uppermost utensil is lifted upwardly until the spoon portion or tine portion of the utensil can be drawn outwardly through the widened portion 78 of the cartridge and the widened portion 40 of the compartment. The remaining utensils are retained within the cartridge until an uppermost utensil of the remaining utensils is removed in a similar manner. As discussed hereinabove, the cartridge may be readily dropped into a respective compartment such that the person loading the dispenser unit does not come in contact with the bowl portion or tine portion of the utensil. Further, removal of the utensils is restricted such that preferably only one utensil can be removed from the dispenser unit at a time.

The cartridge 60 is preferably formed of a paperboard material as discussed hereinabove and may be automatically formed, filled and sealed at the place of manufacture. The cartridges have a top and bottom, one of which will remain open during its manufacture in order to allow the utensils to be inserted into the cartridge as a unit. Alternatively, the backwall 68 may be hinged along one of the sidewalls 70 or 74 such that the utensils may be inserted as a single unit through the backwall with the handle portions of the utensils extending through the elongated slot 76. Again, by loading the cartridges at the place of manufacture the sanitary nature of the dispensing unit can be preserved. Moreover, the operator may readily fill the dispensing unit by inserting the pre-filled cartridge into the intended compartment. Again, this allows for the sanitary display of the utensils as well as a quick and efficient manner for restocking the dispensing unit.

Figure 4:
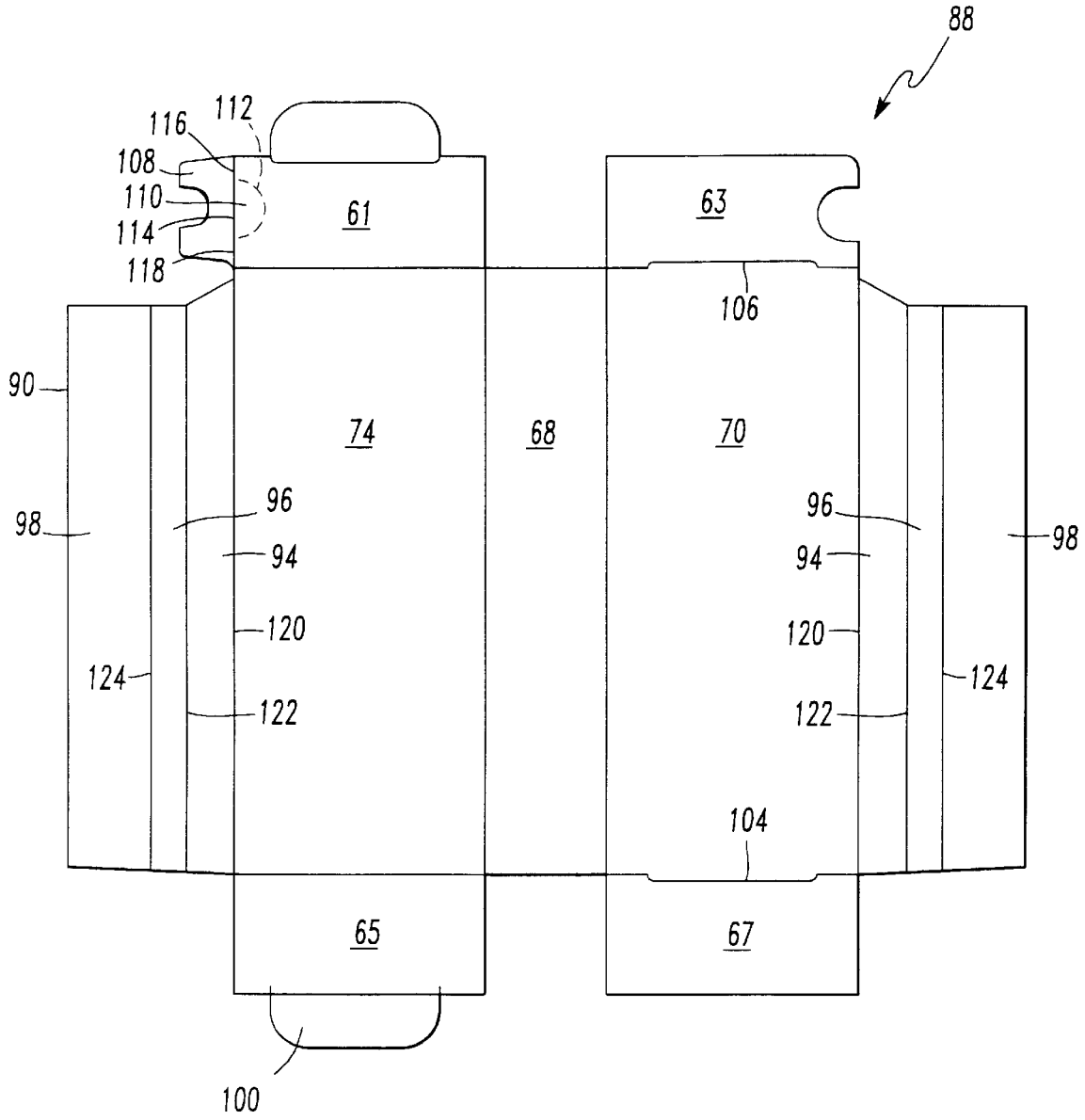
FIG. 4 is a plan view of a blank for forming the cartridge of FIG. 3.

In this regard, reference is now made to FIGS. 4 and 5 wherein a blank for forming the cartridge 60 will be discussed in greater detail. As discussed hereinabove, the blank includes sidewalls 68, 70 and 74 with the front wall 72 being formed from the adjoining multiple panels 90 and 92. Each of the multiple panels 90 and 92 include a first panel 94 hingedly connected to one of the side panels 70 and 74, a second panel 96 hingedly connected to the first panel 94 and a third panel 98 hingedly connected to the second panel 96. The significance of the multiple panels will be discussed in further detail with respect to FIG. 5. Additionally, the blank 88 includes end flaps 61, 63, 65 and 67 which form end walls 64 and 66 of the cartridge 60 illustrated in FIG. 3. The end flaps 61 and 65 each include securing tabs 100 and 102 for insertion into complimentary slits 104 and 106 for closing the top and bottom of the cartridge in a conventional manner. Further, hingedly secured to the end flap 61 is a retaining tab 108 which includes a portion 110 of the end flap 61 which is defined by perforated cut score line 112. The retaining flap 108 is hingedly secured to the portion 110 by way of fold line 114, however, it is separated from the remaining portion of the end flap 61 by cut score lines 116 and 118.

As can be seen from FIG. 3, when the cartridge is formed from the blank 88, the retaining flap 108 is positioned behind the wall 72 in order to retain the flatware within the cartridge until such time as it is desired for such utensils to be dispensed from the cartridge. That is, before the cartridge is inserted into the compartment 32, the retaining tab 108 is removed by breaking along the perforated line 112, thus separating the retaining tab from the end flap 61. This permits the uppermost flatware to be raised and removed from the cartridge through the opening 78.

In order to maintain the flatware within the cartridge during shipment and handling by the user, the front wall 72 must be of an adequate strength to prevent the flatware from being pulled from the cartridge prior to its insertion into the respective compartment. This is accomplished by providing multiple panels 90 and 92. As discussed hereinabove, the multiple panels include first, second and third panel sections 94, 96 and 98 respectively. Initially, the multiple panels are over-folded along fold line or partial cut score line 120 through an arc of greater than 90°, and subsequently folded along fold line or cut score lines 122 and 124 such that the inner surfaces of each of panels 94 and 96 face one another and the inner surface of the third panel 98 rests on and is adhered to the inner surface of the respective side panel 70 and 74. In order to assure that the panel 94 will be positioned in the manner illustrated in FIG. 7, the lateral dimension, that is the dimension between fold lines 120 and 122 is greater than the lateral dimension between fold lines 122 and 124. In doing so, when the third panel 98 is adhered to the inner surface of the sidewall 70 and 74, the front wall 72 formed by the multiple panels 90 and 92 will take on the position and configuration illustrated in FIG. 7.

Figure 5:
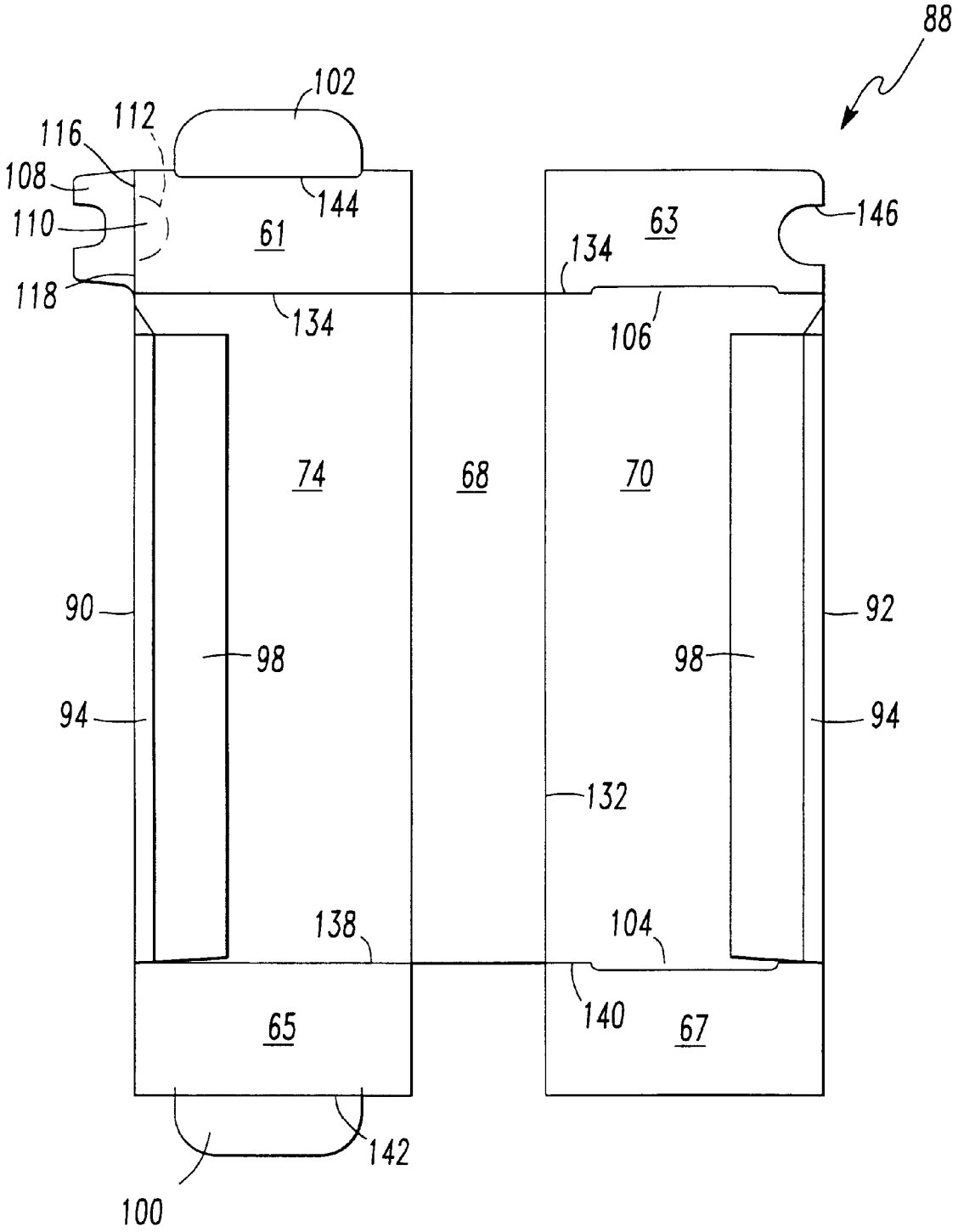
FIG. 5, is a plan view of the blank at FIG. 4 in the partially erected conditioned.

With reference to FIG. 5, once the multiple panels 90 and 92 are over-folded and adhered to the respective sidewall 70 and 74, the remaining portion of the cartridge is subsequently formed by a folding along fold lines 130 and 132 in order to define the sidewall 68 and over-folding along fold lines 134, 136, 138 and 140 in order to position the end panels for closing the top and bottom of the cartridge. As referred to hereinabove, the tabs 100 and 102 are over-folded along fold lines 142 and 144 respectively and inserted into slits 104 and 106 as best illustrated in FIG. 3. It should be noted, when over-folding the end flap 61, the retaining tab must also be over-folded along fold line 114 and positioned behind the panel 94 and 96. It should also be noted that the end panel 63 includes notch 146 which substantially coincides with the portion 110 so as to permit ease in removing the utensils from the cartridge when desired.

Figure 6:
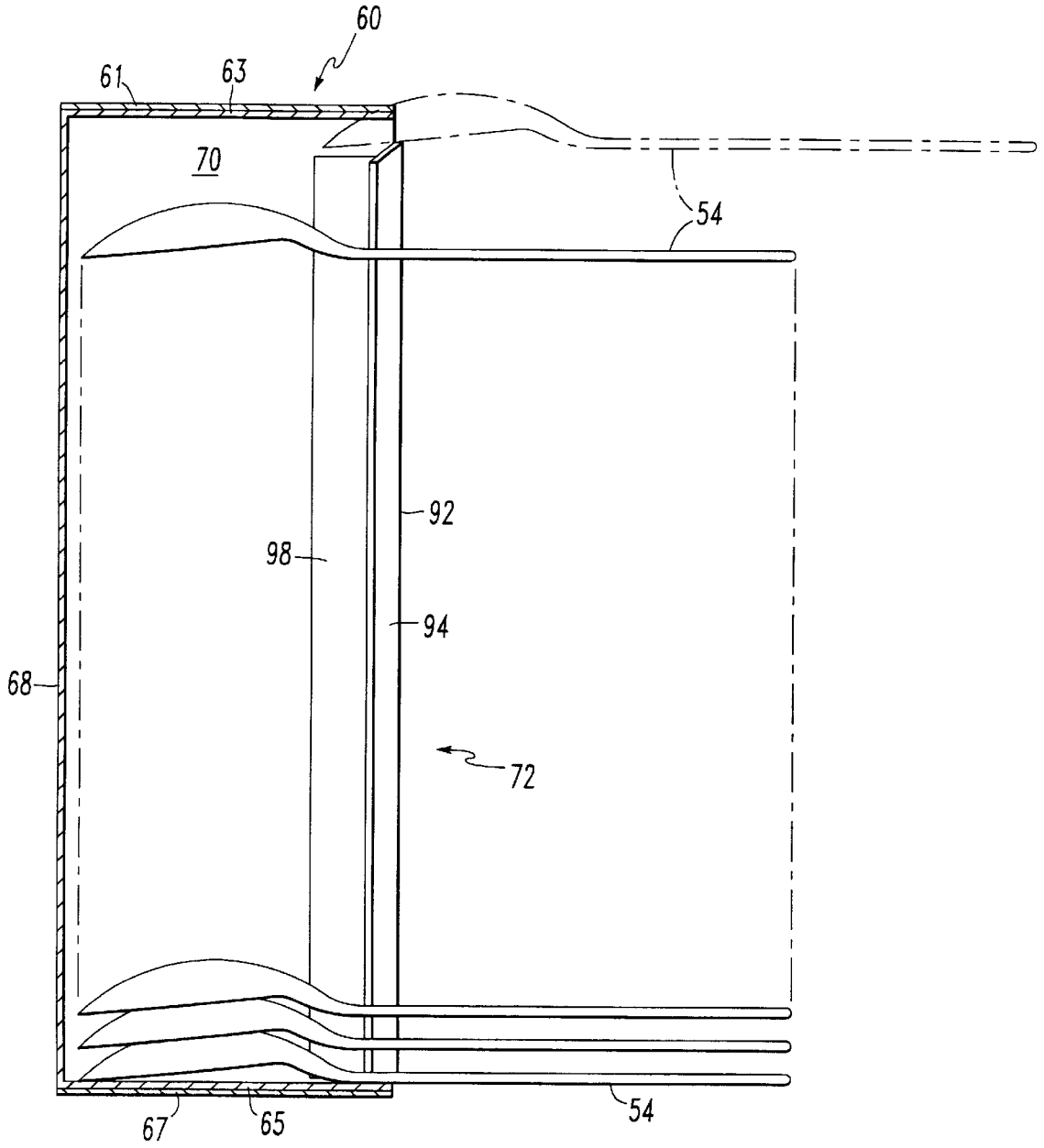
FIG. 6 is a cross-sectional view of the cartridge illustrated in FIG. 3 taken along line VI—VI having a utensil in the partially removed position.

Referring now to FIGS. 6 and 7, as is noted hereinabove, the side panel 72 which is formed from multiple panels 90 and 92 is angled inwardly in order to retain the flatware 54 within the cartridge 60. That is, should the flatware be inadvertently pulled outwardly prior to the cartridge being inserted into the respective compartment, the front wall 72 will restrain outward movement of the flatware 54. If the retaining walls were merely of a single thickness having an appropriate slit formed therein, the utensil could be readily pulled from the cartridge prior to its insertion into the compartment. As discussed hereinabove, when it is desired to remove the utensils 54 from the cartridge 60, the retaining tab 108 is removed from the cartridge thus permitting the utensils 54 to be sequentially removed from the cartridge by raising the uppermost flatware and drawing the flatware out through the opening 78.

Again, as discussed hereinabove, in order to fill the dispenser 10, the top wall 22 is removed from the dispenser exposing the top of the respective compartments 32–35 and the secondary housing 30. The retaining tab 108 of the cartridge 60 is then removed so as to permit an uppermost utensil to be removed from the cartridge. The cartridge is then dropped into the respective compartment and the top wall 22 then replaced on the dispenser 10. In this manner, removal of the utensils is limited to the uppermost utensil in each cartridge while exposing only the handle portion of the utensil.

With respect to the secondary housing 30, the elongated utensils 58 are positioned in a vertical manner in the cartridge 44 which includes a front wall which is partially removable. Additionally, as can be seen from FIG. 2, the removable portion of the front wall of the cartridge 44 includes slanted portions which aid in directing the elongated utensils 58 towards the opening in the secondary housing. Again, as with the cartridge 60, when the top wall 22 of the dispenser 10 is removed, the cartridge 44 can be dropped into the secondary housing after a portion of the front panel of the cartridge is removed to permit access to the elongated utensils 58. In this manner, the consumer is restricted from access to the entire elongated utensil. Further, the consumer is discouraged from removing several utensils at once.

With reference now to FIGS. 8–12, a more preferred embodiment of the present invention will now be discussed in detail. Like reference numerals will be utilized in referring to like components of the dispensing unit and flatware throughout the discussion.

Figure 8:
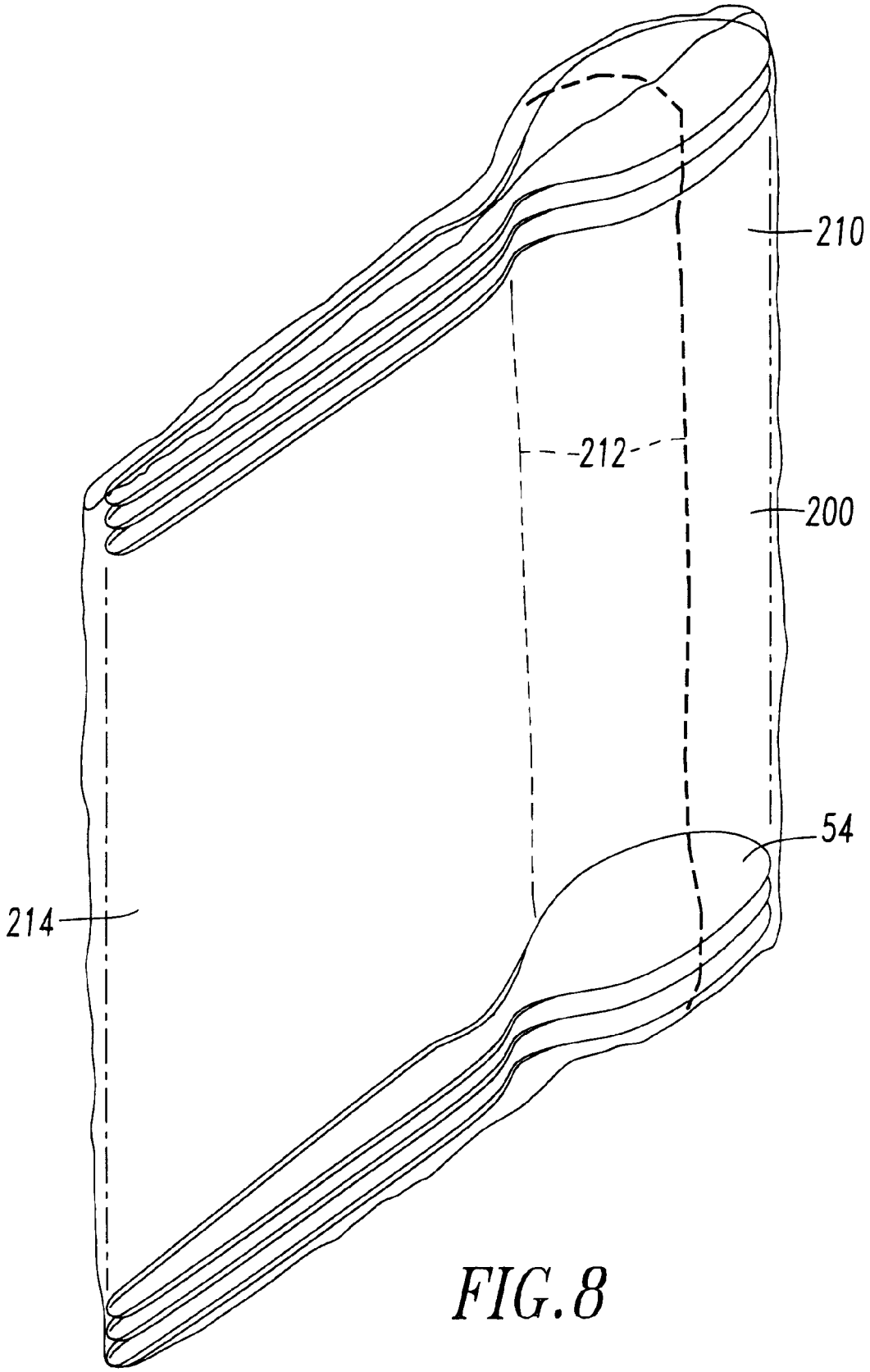
FIG. 8 is a perspective view of a unitary package for flatware in accordance with a preferred embodiment of the present invention.

With reference to FIG. 8, an elongated stack of utensils, in this case spoons 54 are enclosed in a flexible polymer wrapping material or film 200 which may be shrinkable upon exposure to heat. This flexible wrapping material takes the place of the aforementioned paperboard container for housing the bulk oriented cutlery. The polymer material may be any suitable wrapping material which is inexpensive and provides a mechanism for maintaining the cutlery in a unitary package. Moreover, the polymer material is substantially moisture impervious and provides a sanitary enclosure for the cutlery. By providing the cutlery in the manner set forth herein, a substantial cost savings and space savings in shipping and storing of the bulk oriented cutlery is realized.

The bulk oriented cutlery 54 may be wrapped in any known manner in the polymer wrapping or film 200. That is, a sleeve may be formed with the flatware being positioned within the sleeve and subsequently heat sealed along a top and bottom portion thereof or a sheet material may be wrapped about a stack of bulk oriented cutlery with the heat seal being carried out along the top, bottom and one elongated side of the stack. This orientation is preferred in that the heat seal seam along the elongated length of the stack is preferably positioned adjacent the bowl, tine or blade portion of the cutlery product so as to readily rupture when removed by the stockperson stocking the dispenser. Additionally, a mechanism such as perforations may be added along a length of the polymer material in order to aid in rupturing of the material when being removed. Further, the perforations may be arranged to form a tear-away portion which may be readily removed prior to positioning the bulk oriented cutlery in the dispenser. This feature will be explained in greater detail hereinabove.

Figure 9:
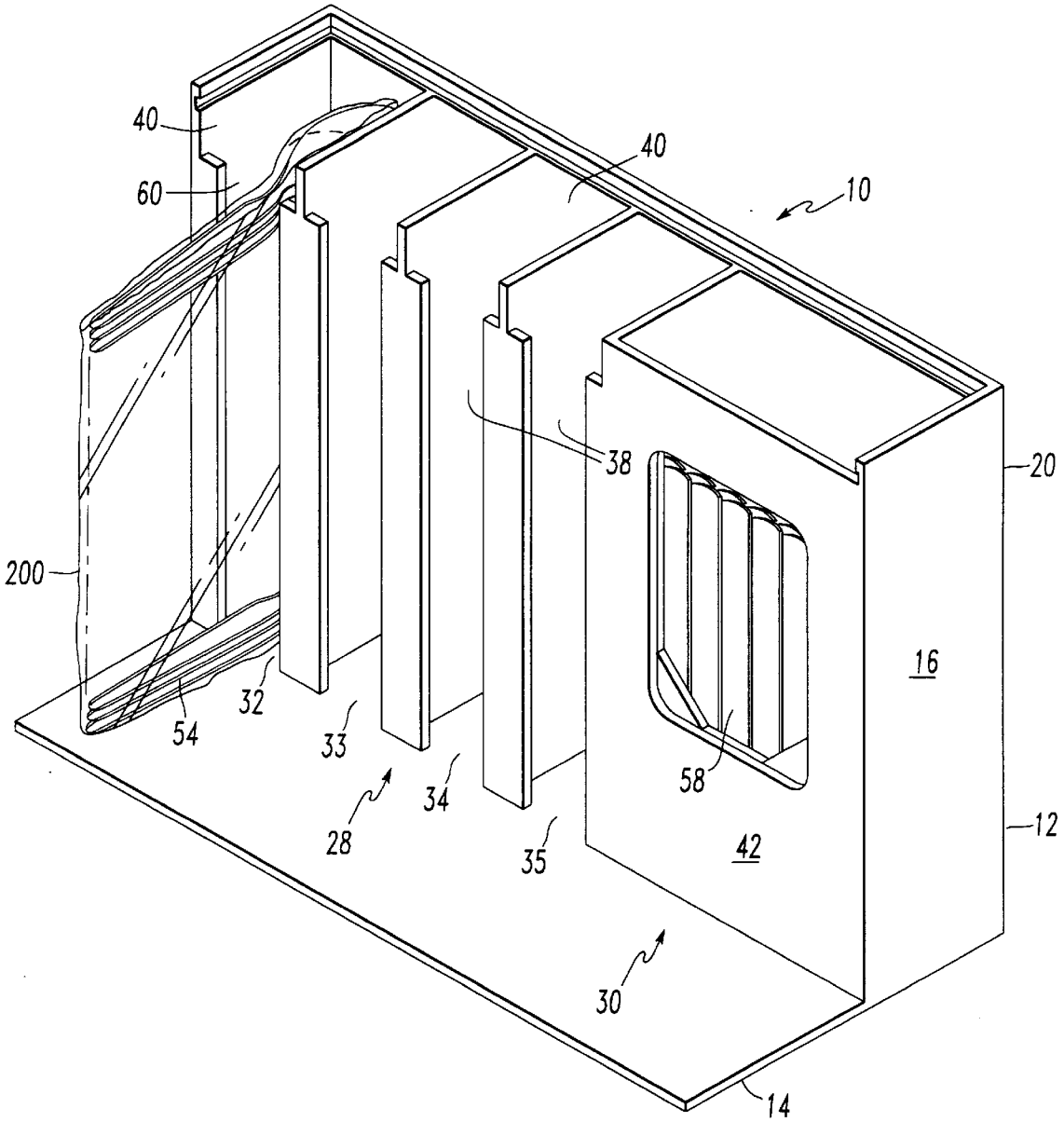
FIG. 9 is a perspective view of the unitary package of FIG. 8 positioned within the flatware dispensing unit of FIG. 1.
Figure 11:
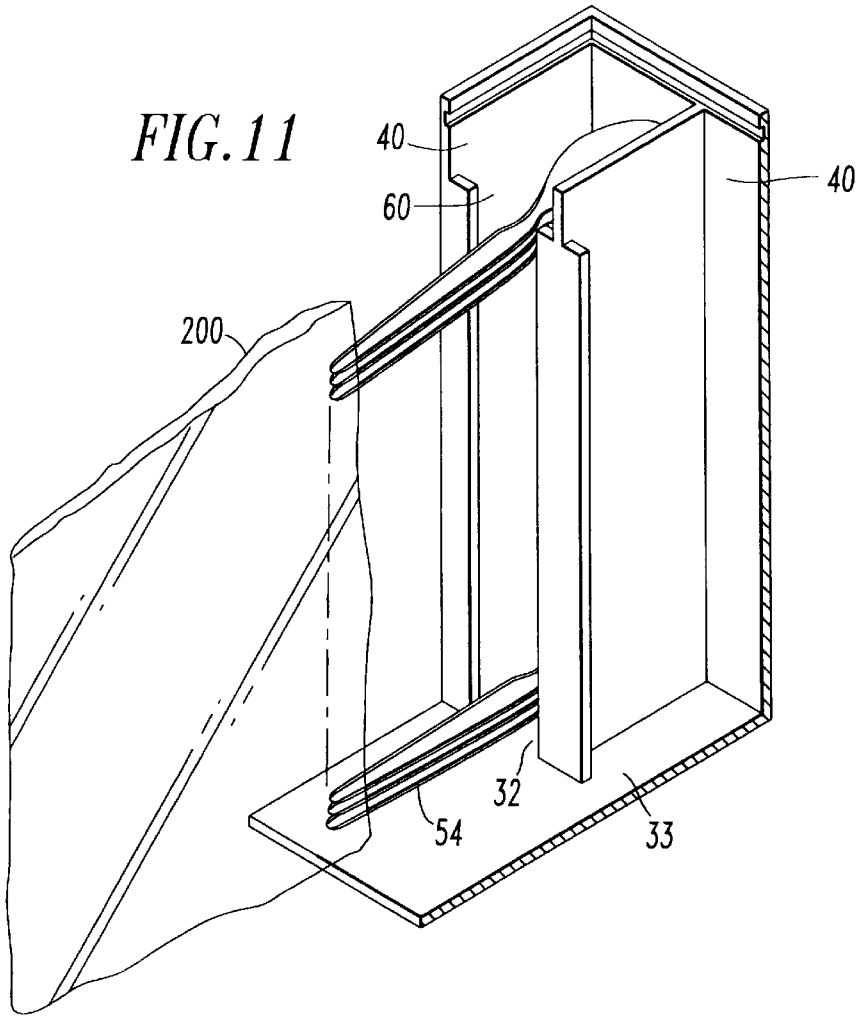
FIG. 11 is a perspective view of the unitary packaging in its substantially removed condition.
Figure 10:
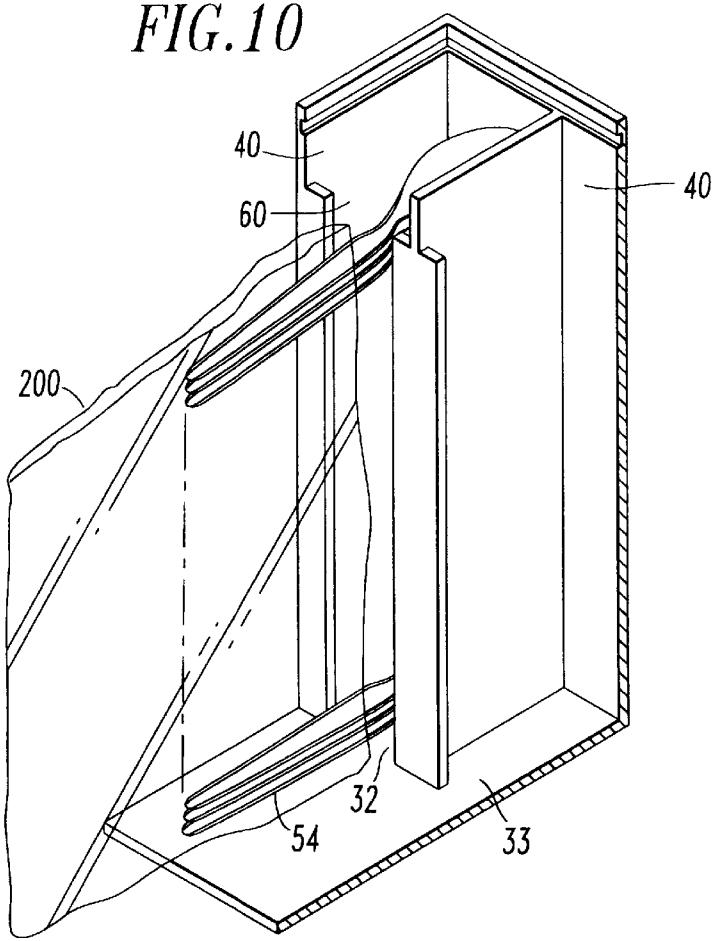
FIG. 10 is a perspective view of the unitary packaging in its partially removed condition.
Figure 12:
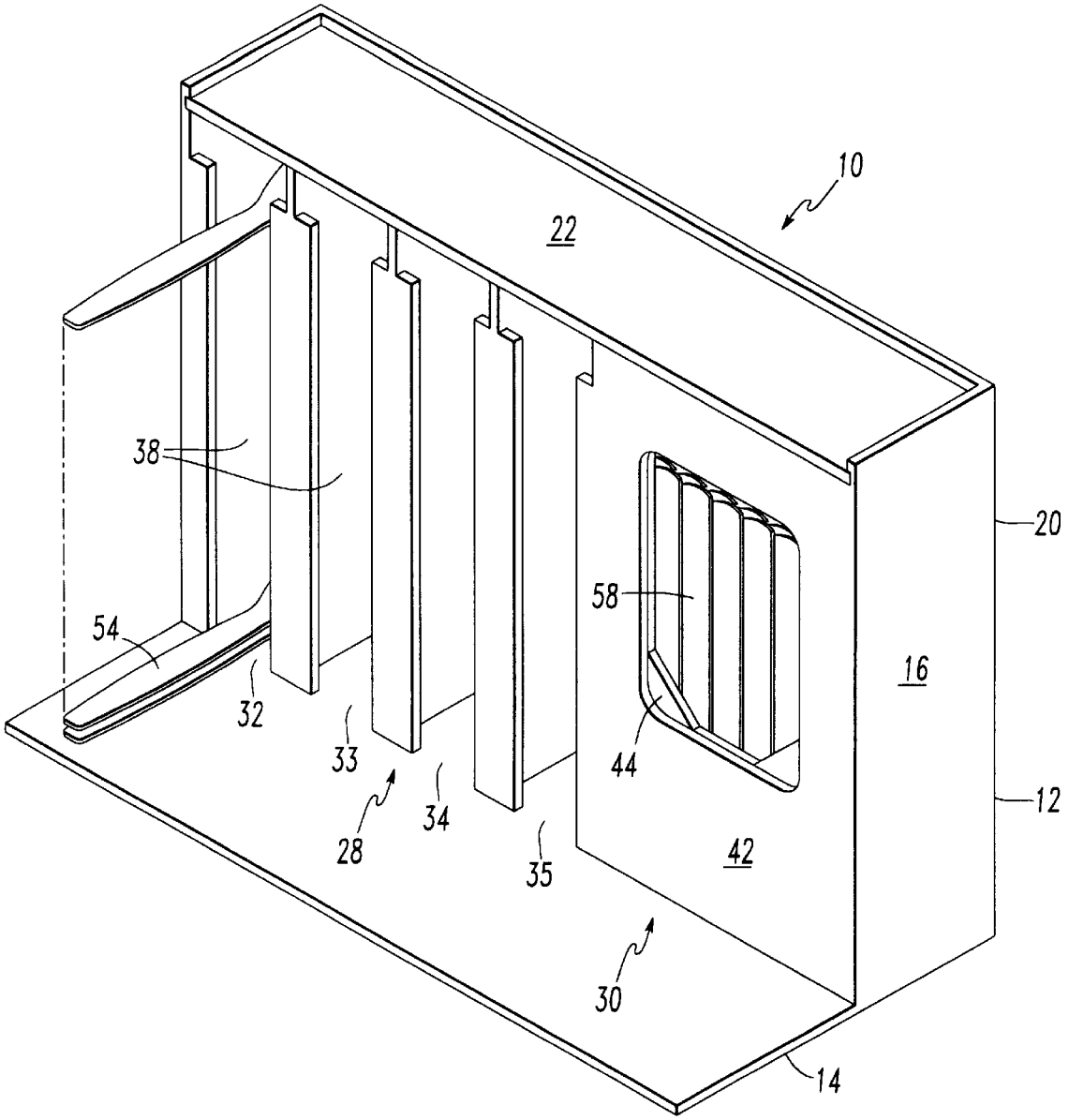
FIG. 12 is a perspective view of the dispensing unit in its loaded and operative condition.

With reference now to FIG. 9, the bulk oriented cutlery stack enclosed within the polymer film 200 is positioned within the dispenser 10 in a manner similar to that set forth in accordance with the previous embodiment. Therein, the cutlery material, and particularly spoons and forks are positioned in a face down manner which aids in stabilizing the stack. Once in the dispenser 10 in the manner illustrated in FIG. 9, the polymer film 200 may be removed from the stack by drawing the polymer film outwardly from the dispensing unit, this being illustrated in each of FIGS. 10 and 11. Again, in order to facilitate the rupturing the polymer film wrapped about the cutlery, perforations may be provided along the length of the wrap. Otherwise, the material may readily rupture along a heat sealed seam.

As an alternative to the removal of the polymer film from the cutlery, the material may be removed upwardly by rupturing along the bottom length of the material. That is, the material may be drawn upwardly about the stack and removed from a top portion of the dispenser. Further, while not specifically illustrated herein, knives may also be provided in a heat shrinkable wrap and positioned within the compartments 32–35 of the dispenser 10 or within the secondary compartment 30 as referred to hereinabove. Additionally, perforations may be positioned anywhere along the polymer film 200 in order to facilitate removal of the film from the bulk oriented cutlery. Still further, as is illustrated in FIG. 8, the polymer film enclosing the bulk oriented stack of cutlery may include a tear-away portion 210 which is defined by perforations 212. The tear-away portion 210 may be readily removed prior to positioning the bulk oriented stack within the dispenser. While the tear-away portion 210 is removed, the remaining portion 214 remains positioned about the stack until the stack is positioned in the dispenser. Once in the dispenser, the remaining portion 214 can be removed. In doing so, the stack is positioned within the dispenser without the utensils being touched and the remaining portion 214 can be easily removed from the stack.

As with the previous embodiment, the dispensing unit includes a main housing 12 having a substantially planar base 14 and side walls 16, 18 and 20. Again, the particular configuration of the side walls 16 and 18 are set forth for illustrative purposes only and may take on any configuration so long as the functional aspects thereof are maintained. The housing 12 includes a top wall 22 which is slidably received in the slots 24 formed in the side walls 16, 18 and 20 such that the top 22 may be readily removed from the housing 12 in order to permit placement of the bulk oriented cutlery therein. Likewise, the housing 12 may be divided into two sections, one being a compartmented portion 28 and the other being a secondary housing portion 30. Again, any configuration of compartments may be utilized in order to achieve the particular dispensing device needed by the customer. Further, each of the compartments 32–35 include a singular front wall 36 with the front wall having an elongated slot 38 provided in each of the compartments as well as widen portions or transverse slots 40 at a top portion of each of the compartments 32–35 which permit the bowl portion of a spoon, the tines of a fork or the blade of a knife to pass therethrough. The removable top 22 allows for the bulk oriented cutlery enclosed in the polymer film to be easily dropped into the respective compartment which allows the dispenser to be filled in a sanitary manner. Once the cartridge is in place, the lid can then be returned to the positioned illustrated in FIG. 12. While the discussion hereinabove notes that the polymer film 200 is to be removed prior to closing the dispensing unit, the top 22 may be replaced prior to removal of the polymer film 200. In this case, the dispensing unit would be completely filled, that is a stack of bulk oriented cutlery would be provided in each of the compartments prior to closing of the dispensing unit with the polymer film 200 being subsequently removed from each of the stacks.

As with the previous embodiment, flatware positioned within the respective compartments are contained therein until such time as the consumer lifts the uppermost utensil and removes the utensil through the transverse opening 40. Consequently, the remaining utensils are retained within the compartment until an uppermost utensil of the remaining utensils is removed in a similar manner.

With the foregoing discussion, it can be readily appreciated that the present invention results in a cutlery dispensing unit wherein the cutlery or flatware is readily accessible to the consumer, however, the consumer is inhibited from simultaneously removing a significant number of utensils. Further, the present invention in accordance with a preferred embodiment thereof is set forth wherein the flatware is provided in a unitary package for ease in restocking the dispensing unit with the unitary packaging being provided so as to store, ship and handle the flatware in a sanitary manner. Moreover, the unitary package is impervious to moisture and thus protects the flatware from the environment. Additionally, by utilizing a flexible unitary package of the type discussed hereinabove, the space necessary for storing and shipping the flatware is significantly reduced.

While the present invention has been described with reference to the preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

Industrial Applicability

The above described dispenser unit may be readily positioned in any fast food type restaurant where flatware is needed. Further, the dispenser unit may be utilized in an office or cafeteria where flatware must be readily accessible to the consumer while preserving the sanitary nature of the flatware and conserving the number of utensils taken at one time.

We claim:

1. A flatware dispensing unit for dispensing flatware comprising a housing having at least one compartment for receiving the flatware, said compartment having an elongated slot for exposing at least a portion of said flatware; and at least one flatware cartridge receivable in said compartment; said cartridge having a complimentary elongated slot substantially aligned with said elongated slot in said compartment when said cartridge is positioned in said compartment;

wherein a handle portion of the flatware extends from said elongated slot in said cartridge and said elongated slot in said compartment such that respective flatware can be sequentially removed from said cartridge retained in said compartment.

2. The unit as defined in claim 1, wherein said elongated slot in said cartridge includes a widened portion for permitting removal of the flatware.

3. The unit as defined in claim 2, wherein said elongated slot in said compartment includes a complimentary widened portion positioned adjacent said widened portion of said elongated slot in said cartridge.

4. The unit as defined in claim 1, wherein said housing includes a plurality of compartments adjacent one another with each of said compartments including an elongated slot.

5. The unit as defined in claim 4, wherein said elongated slots of said compartments extend substantially parallel to one another.

6. The unit as defined in claim 5, wherein said housing includes a substantially planar base and said elongated slots of said compartments extend substantially perpendicular to said planar base.

7. The unit as defined in claim 1, wherein said cartridge is formed of a disposable paperboard material.

8. The unit as defined in claim 1, further comprising a secondary housing for accommodating and dispensing elongated flatware adjacent said compartment in said housing and a second cartridge for accommodating the elongated flatware receivable in said secondary housing, said second cartridge and said secondary housing each including an opening such that at least a portion of said elongated flatware is accessible through said openings.

9. The unit as defined in claim 8, further comprising directional means formed in said second cartridge for directing the elongated flatware towards said opening.

10. The unit as defined in claim 9, wherein said directional means includes tapered portions of the opening in said second cartridge.

11. A flatware dispensing unit for dispensing flatware comprising;

a primary housing having a substantially planar base, at least one compartment for accommodating flatware and a secondary housing for receiving elongated flatware, said at least one compartment having an elongated slot extending substantially perpendicular to said base for exposing at least a portion of said flatware; and at least one flatware cartridge receivable in said compartment, said cartridge having a complimentary elongated slot and retaining means for retaining the flatware within said cartridge;

wherein a portion of said retaining means is removed from said cartridge before positioning said cartridge in said compartment.

12. The unit as defined in claim 11, wherein said elongated slot in said cartridge includes a widened portion for permitting removal of the flatware.

13. The unit as defined in claim 12, wherein said elongated slot in said compartment includes a complimentary widened portion positioned adjacent said widened portion of said elongated slot in said cartridge.

14. The unit as defined in claim 11, wherein said housing includes a plurality of compartments adjacent one another with each of said compartments including an elongated slot.

15. The unit as defined in claim 14, wherein said elongated slots of said compartments extend substantially parallel to one another.

16. The unit as defined in claim 11, wherein said cartridge is formed of a disposable paperboard material.

17. A paperboard container for containing a plurality of disposable flatware comprising;

a top wall and a bottom wall;

a plurality of sidewalls extending between said top wall and said bottom wall;

a front wall adjacent said sidewalls and extending between said top wall and said bottom wall; said front wall including an elongated opening for exposing a handle portion of the flatware; and a retaining means for retaining the flatware within the container, said retaining means including at least a portion of said front wall and a retaining tab extending from said top wall adjacent said elongated opening, wherein said retaining means contacts an expanded portion of the flatware to retain the flatware in the container.

18. The container as defined in claim 17, wherein said front wall includes at least two wall sections commencing adjacent respective sidewalls and extending into an interior of said container, with said elongated opening being formed between said wall sections.

19. The container as defined in claim 18, wherein a height of said wall sections is less than a height of said plurality of sidewalls forming a second opening adjacent said top wall, said second opening extending substantially transverse to said elongated opening.

20. The container as defined in claim 19, wherein said retaining tab overlies said second opening and extends into an interior of the container.

21. The container as defined in claim 20, wherein said retaining tab includes a portion of said top wall defined by a perforated cut score line.

22. The container as defined in claim 18, wherein said two wall sections include first and second panels hingedly connected to one another having an inner surface of said first panel facing an inner surface of said second panel and a third panel hingedly connected to said second panel having an inner surface of said third panel adhered to an inner surface of an adjacent sidewall.

23. The container as defined in claim 18, wherein a lateral dimension of said second panel is less than a lateral dimension of said first panel.

24. A flatware dispensing unit for dispensing flatware comprising;

a housing having at least one compartment for receiving the flatware, said compartment having an elongated slot for exposing at least a portion of said flatware; and at least one flatware cartridge containing a plurality of flatware pieces temporarily receivable in said compartment;

wherein said cartridge is removable from said compartment while the flatware is radiant in said compartment such that the flatware can be sequentially removed from said compartment.

25. The unit as defined in claim 24, wherein said elongated slot in said compartment includes a widened portion for permitting removal of the flatware.

26. The unit as defined in claim 24, wherein said housing includes a plurality of compartments adjacent one another with each of said compartments including an elongated slot.

27. The unit as defined in claim 26, wherein said elongated slots of said compartments extend substantially parallel to one another.

28. The unit as defined in claim 27, wherein said housing includes a substantially planar base and said elongated slots of said compartments extend substantially perpendicular to said planar base.

29. The unit as defined in claim 24, wherein said cartridge is formed of a polymer material.

30. The unit as defined in claim 24, further comprising a secondary housing for accommodating and dispensing elongated objects adjacent said compartment in said housing and a second cartridge for accommodating the elongated objects receivable in said secondary housing.

31. A cartridge for positioning a plurality of disposable flatware in a flatware dispenser comprising;

a plurality of flatware oriented in the same manner forming a bulk oriented stack of flatware; and a flexible enclosure enclosing said bulk oriented stack of flatware and maintaining an orientation of said bulk oriented stack of flatware;

wherein said bulk oriented stack of flatware in said flexible enclosure is positioned in the flatware dispenser, with said flexible enclosure being removable from said bulk oriented stack of flatware.

32. The cartridge as defined in claim 31, wherein said flexible enclosure is a polymer film.

33. The cartridge as defined in claim 32, wherein polymer film is of a heat shrinkable polymer material.

34. The cartridge as defined in claim 32, further comprising a rupture means for rupturing said flexible enclosure.

35. The cartridge as defined in claim 34, wherein said rupture means is a line of weakness formed in said polymer film.

36. The cartridge as defined in claim 35, wherein said line of weakness is a heat seal adjoining portions of said polymer film.

37. The cartridge as defined in claim 35, wherein said line of weakness is a series of perforations formed in said polymer film.

38. The cartridge as defined in claim 37, wherein said perforations define a tear-away portion in said flexible closure.

39. The cartridge as defined in claim 38, wherein said tear-away portion is removed before said flexible enclosure is positioned in the flatware dispenser.

40. A method of stocking a flatware dispenser comprising the steps of:

providing a flatware dispensing unit for dispensing flatware, said dispensing unit including a housing having at least one compartment for receiving the flatware, said compartment having an elongated slot for exposing at least a portion of said flatware;

providing a plurality of flatware oriented in the same manner forming a bulk oriented stack of flatware, said bulk oriented stack of flatware being enclosed in a flexible enclosure for maintaining an orientation of said bulk oriented stack of flatware;

positioning said enclosed bulk oriented stack of flatware in said compartment having said portion of said flatware enclosed in said flexible enclosure extending from said compartment; and removing said flexible enclosure from said compartment leaving said bulk oriented stack of flatware retained in said compartment such that the flatware can be sequentially removed from said compartment.

41. The method as defined in claim 40, wherein said flexible enclosure is a polymer film.

42. The method as defined in claim 41, wherein polymer film is of a heat shrinkable polymer material.

43. The method as defined in claim 41, further comprising rupturing said flexible enclosure along a line of weakness formed in said polymer film.

44. The method as defined in claim 43, wherein said line of weakness is a heat seal adjoining portions of said polymer film.

45. The method as defined in claim 43, wherein said line of weakness is a series of perforations formed in said polymer film.

46. The method as defined in claim 45, wherein said perforations define a tear-away portion in said flexible closure.

47. The method as defined in claim 46, further comprising the step of removing said tear-away portion prior to positioning said enclosed bulk oriented stack of flatware in said compartment.

* * * * *